US005393138A

United States Patent [19]

Federhen

[11] Patent Number: 5,393,138

[45] Date of Patent: Feb. 28, 1995

[54] APPARATUS FOR MIXING FOUNDRY MOULD SUBSTANCES

[76] Inventor: Bernd Federhen, Zeppeliustr. 12, 59 Siegeu, Germany

[21] Appl. No.: 15,453

[22] Filed: Feb. 9, 1993

Related U.S. Application Data

[63] Continuation of Ser. No. 656,004, Feb. 15, 1991, abandoned.

[30] Foreign Application Priority Data

Mar. 5, 1990 [DE] Germany ..... 4006846

[51] Int. Cl.[6] ..... B28C 5/08; B01F 7/02; B01F 7/16

[52] U.S. Cl. ..... 366/64; 366/307; 366/325

[58] Field of Search ..... 366/64, 66, 302, 303, 366/307, 329, 325

[56] References Cited

U.S. PATENT DOCUMENTS

| | | | |
|---|---|---|---|
| 1,546,335 | 7/1925 | Browne | 366/64 |
| 2,029,690 | 2/1936 | Wilson | 366/307 |
| 2,082,796 | 6/1937 | Gaertner | 366/307 |
| 2,227,522 | 1/1941 | Weigel | 366/322 |
| 2,626,786 | 1/1953 | McGlothlin | 366/303 |
| 3,980,013 | 9/1976 | Bredeson | 366/307 |
| 4,155,657 | 5/1979 | King | 366/302 |
| 4,194,925 | 3/1980 | Holbrook | 366/64 |

FOREIGN PATENT DOCUMENTS

| | | | |
|---|---|---|---|
| 625884 | of 0000 | France | 366/329 |
| 1173787 | 7/1964 | Germany | 366/302 |
| 71608 | 2/1953 | Netherlands | 366/307 |
| 635376 | 4/1950 | United Kingdom | 366/329 |

*Primary Examiner*—David A. Scherbel
*Assistant Examiner*—Randall E. Chin
*Attorney, Agent, or Firm*—Bachman & LaPointe

[57] ABSTRACT

In an apparatus for mixing foundry mould substances, in particular sand and binding agent, comprising a mixing tool which projects from a drive shaft and which is rotatable therewith in a container, fitment bodies (30) of small lateral extent (a, d) project from the wall (12) of the container (10) at a spacing in parallel relationship to the shaft from the free end (29) of the rotatable mixing tool (24).

13 Claims, 2 Drawing Sheets

Figure 4:
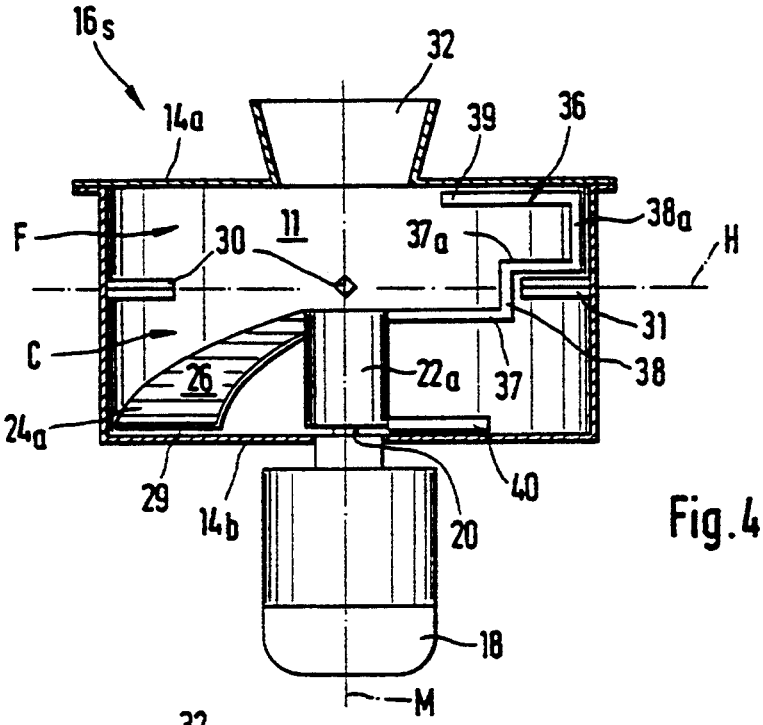

Fig.1
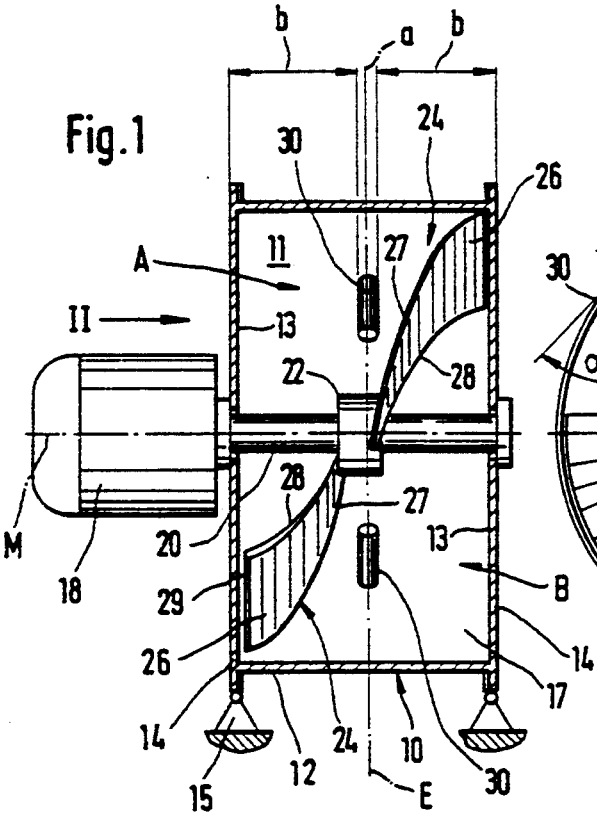
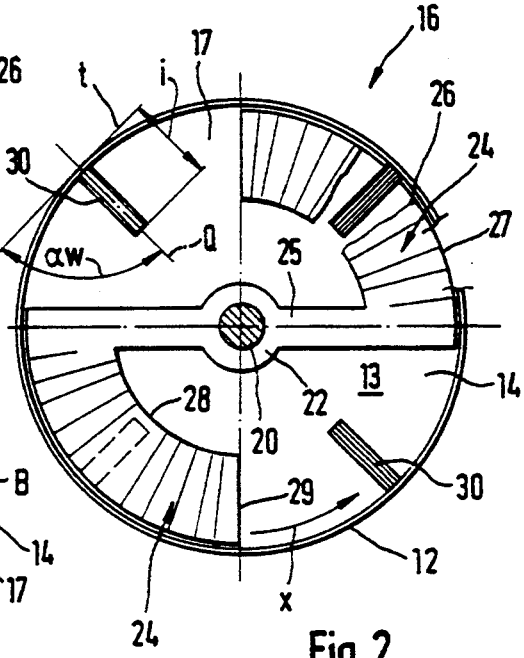
Fig.2
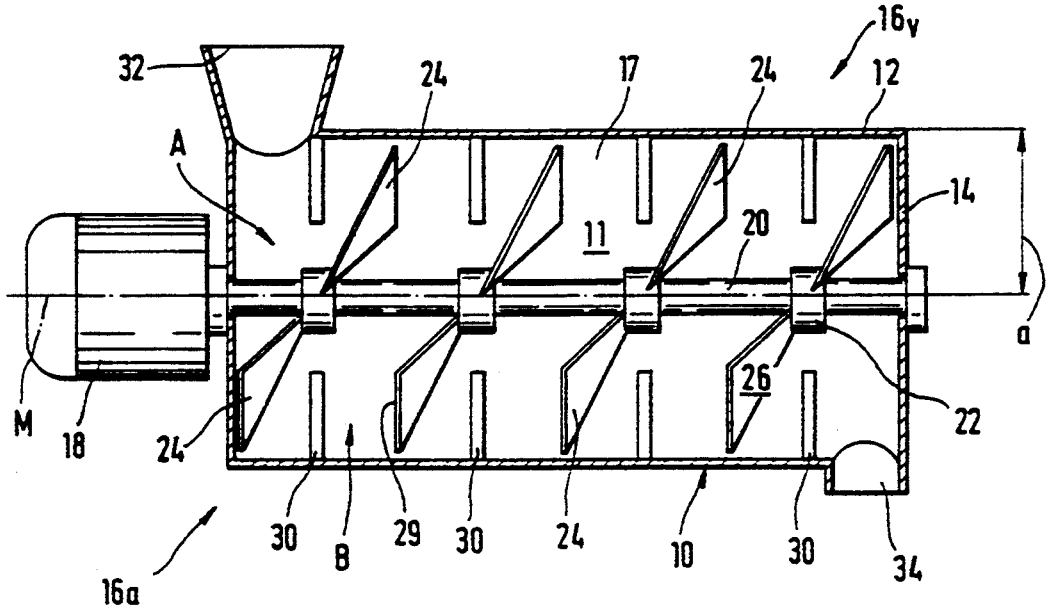
Fig.3

APPARATUS FOR MIXING FOUNDRY MOULD SUBSTANCES

This is a continuation of application Ser. No. 656,004, filed Feb. 15, 1991, now abandoned.

DESCRIPTION

The invention relates to an apparatus for mixing foundry mould substances, in particular sand and binding agent, comprising a mixing tool which projects from a drive shaft and which is rotatable with same in a container.

Mixers of that kind with a rotating mixing tool are conventionally used in the foundry industry for mixing sand and binding agents. Their mixing effect is achieved by virtue of the fact that the mixing tools which are of a vane-like or blade-like configuration rotate relative to the material to be mixed at a relative speed, and rub the material to be mixed, disperse it and turn it over in layers. The material to be mixed is braked by the wall of the mixing container and is moved at the centre by the mixing tool.

In accordance with German patent specification No 2 608 775, mixing tools may operate with a horizontal drive shaft in extended continuous flow mixers, while in accordance with German utility model No 82 34 900 they may operate with a vertical drive shaft or with an inclinedly disposed axis, in rotational mixers which are to be filled in a batch-wise manner.

The mixing action of mixers with a rotating mixing tool may be increased by increasing the speed of rotation of the mixing tool until the friction of the material to be mixed against the wall of the mixing container is no longer sufficient and the material being mixed follows the rotary movement of the mixing tool, as a more or less compact mass. That means that the rubbing, dispersing and turning-over forces required for the mixing operation are restricted. The disadvantageous effect of that phenomenon is particularly noticeable when there are also viscous components in the material being mixed.

If, in mixers with a vertical axis, the speed of rotation is to be increased, profile members are used above the mixing tools, the longitudinal axes of the profile members extending parallel to the wall of the mixing container to which they are secured. Those profile members brake the material being mixed. In that region however it is not possible for the wall of the mixing container to be kept free from caked-on deposits by a rotating scraper. On the one hand, the caked-on materials are missing in the mixture while on the other hand under some circumstances they require a considerable amount of expenditure on cleaning.

In consideration of those factors the inventor set himself the aim of providing an apparatus of the general kind set forth, having a rotating tool, which apparatus on the one hand affords a high level of mixing intensity while on the other hand it is kept substantially free from caked-on materials by virtue of the mixing tools and the movement of the material to be mixed.

The object envisaged by the inventor is attained in that at a spacing in parallel relationship with the shaft from the free end of the rotatable mixing tool at least one fitment body of shall lateral extent projects from the wall of the container into the material to be mixed.

For that purpose it has been found advantageous for the fitment body to be of a blade-like configuration or to be in the form of a pin of small cross-section or a bar of drop-like cross-section.

Due to the small lateral extent of the fitment bodies, the flow of material being mixed keeps the wall of the container free from caked-on deposit in the region between the fitment bodies. The specific selection in respect of number, cross-section and length of the fitment bodies as well as the angle of attack thereof relative to the mixer wall makes it possible to determine the mixing characteristic within wide limits.

Fitment bodies which, in accordance with the invention, are slim, blade-like or of a drop-like cross-section, cause the flow of material being mixed to be divided up with a small amount of friction. They make it possible for example to effect rapid mixing of dry temperature-sensitive substances. More voluminous cross-sections give rise to a greater frictional influence and are for example better suited for mixing solid and fluid components together; for example fitment bodies of circular cross-section for dealing with quartz sand with a liquid binding agent.

In order to influence the flows of material being mixed, the axis of the fitment body may also be of a curved configuration; when the fitment bodies are of a twisted nature, additional three-dimensional flows are produced in the material being mixed, which may be helpful for example when mixing liquid components.

It is also possible in accordance with the invention for the fitment bodies to be connected by rings or spirals crossing same to provide a sieve-like flow body; as the parts of such a sieve configuration stabilise each other, they can be made of particularly small thickness without deflecting under the pressure of the flow of material being mixed.

In accordance with a further feature of the invention the fitment bodies determine a common plane which divides the interior of the container into mixing spaces. Preferably the fitment body is provided between at least two mixing tools which project in adjacent relationship from the drive shaft and each of which rotates in one of the mixing spaces and conveys the material to be mixed selectively from one of the mixing spaces into the other. In that situation the rotary movement of the mixing tools is transmitted to the material to be mixed. Those fitment bodies gives rise to strong shearing and frictional forces which make it possible to provide for intensive rapid mixing of the components to be mixed.

In an embodiment of the apparatus according to the invention, at least two mixing tools project in displaced relationship from a common carrier ring or like carrier element on the drive shaft, wherein said plane for the fitment bodies extends substantially vertically between same. It is also possible for a plurality of such mixing tool units to be combined one behind the other axially with fitment or flow bodies arranged therebetween, to provide a continuous-flow mixer. Different settings for the positions of the blades of the mixing tool cause the superimposition on the mixing movement of a transportation component for transportation of the material from the inlet for the material to be mixed to the discharge thereof.

It is also in accordance with the invention for a plurality of mixing tool blades, instead of one, to be provided on the mixer axis in each of the mixing spaces.

A further construction has the fitment bodies in the container above the mixing tool, which define a plane which is horizontal or inclined relative to the horizontal and which separates two mixing spaces which are disposed one above the other. Beneath that plane the mixing tool which projects from the drive shaft is connected to a stripping device which extends over said plane. As, in a construction with a perpendicular or inclined axis, the force of gravity moves the material to be mixed downwardly, it is sufficient for a mixing tool which is set in a pitch position to be arranged only in the lower mixing space; the return transportation movement is produced by the force of gravity. It is also sufficient here for the upper mixing space to be kept free from caked-on material by means of a light stripping device.

A stripping device which has proven to be advantageous comprises a bar-like portion projecting radially from the drive shaft, a second portion which is inclined with respect to the bar-like portion and which extends in front of the end faces of the fitment bodies, and a further portion which extends at the inside of the container.

In addition, the arrangement may preferably also have a portion which can be guided at the cover of the closed container; by virtue thereof, the inside of the cover is kept free from caked-on deposit and the second portion of the stripping device provides that in the upper mixing space material being mixed which clings on and to the end faces of the fitment bodies is stripped off and a new radial motion component is imparted to the material to be mixed, which is braked in the region between the fitment bodies . Before the material being mixed can fall back into the lower mixing space, it is again radially distributed.

An apparatus according to the invention for distributing viscous media on the surface of granular substances includes, beneath the plane defined by the fitment bodies, a mixing tool which projects from the drive shaft and at least one roller which rotates relative to the drive shaft and whose peripheral surface advantageously defines an acute angle with the inside surface of the container. The axis of the roller should include with the drive shaft an angle which is less than 90°.

Upon rotation of the entire mixing rotor assembly, the roller performs an additional rotary movement of its own, due to the frictional forces acting thereon, whereby the above-mentioned distribution of viscous media on the surface of granular substances is improved. The angular positioning imparts an additional three-dimensional turning-over effect to the material being mixed.

It has been found advantageous for the roller or the peripheral surface thereof to be tapered conically towards the plane of the fitment bodies and/or for the upper end face of the roller to be provided at a small spacing relative to the associated fitment bodies in order in that way to promote the action of stripping off the material to be mixed.

The fact that the peripheral surface of the roller is provided with projections and/or recess means results in an increase in squeezing and shearing forces acting on the material being mixed.

Further features of the invention are set forth in the subsidiary claims.

Figure 5:
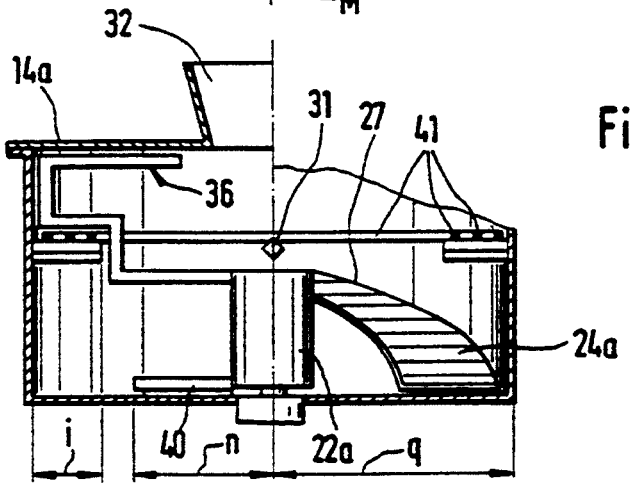
Figure 6:
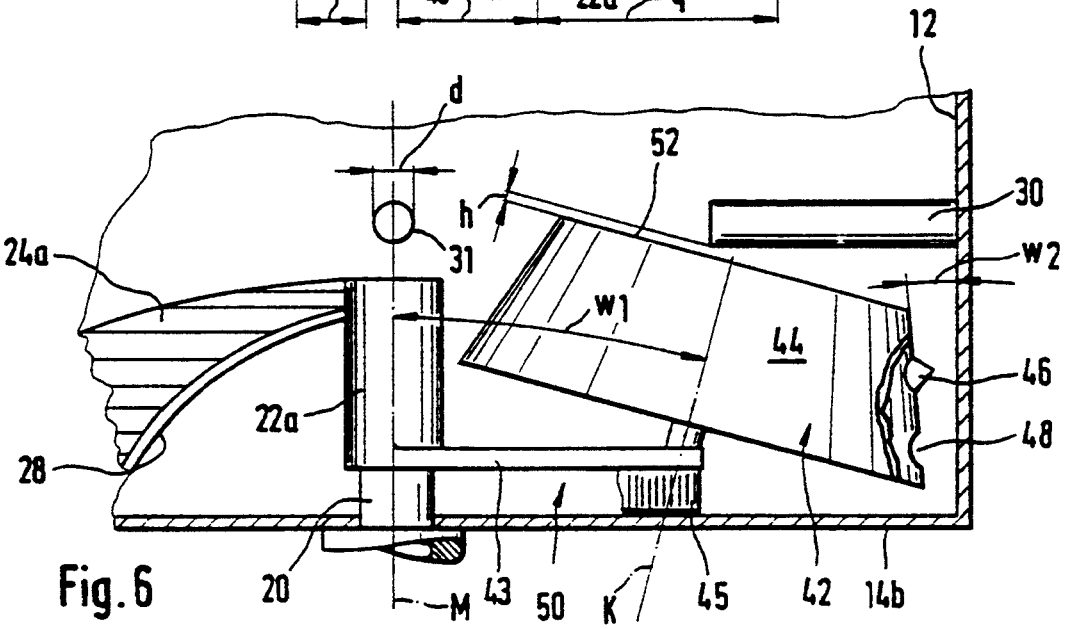

Further advantages, features and details of the invention will be apparent from the following description of preferred embodiments and with reference to the accompanying diagrammatic drawings in which:

FIG. 1 is a view in longitudinal section through a mixer with two ploughshare-like mixing tools on a horizontal drive shaft in a container, FIG. 2 is a view into the container viewing in the direction indicated by the arrow II in FIG. 1, FIG. 3 is a view in longitudinal section of another construction of the mixer with a plurality of mixing tools, FIG. 4 is a view in longitudinal section through a mixer with a vertically extending drive shaft, and FIGS. 5 and 6 show portions from further embodiments of the mixer.

A container or housing 10 comprising a peripheral cylindrical housing portion 12 and disc-like end walls 14 of a mixer 16 which is mounted at 15 for mixing sand and binding agents in the foundry industry has a drive shaft 20 which extends therethrough, being driven by a motor 18 and mounted in the end walls 14, as shown in FIG. 1.

Carried on the drive shaft 20 is a carrier ring 22 for two mixing tools 24 which project radially therefrom and which are of a ploughshare-like configuration and which in the selected embodiments each comprise a radial arm 25 and a curved part-annular surface 26. The edges 27 and 28 of the mixing tools 24, which are shown in particular form in FIG. 2, appear in the form of S-shaped contours in FIG. 1.

The outer edge 27 is adapted in regard to its shape to the inside 11, which is adjacent thereto, of the peripheral housing portion 12. The end edges 29 of the mixing tools 24 extend radially relative to the drive shaft 20 adjacent to the inside surface 13 of the end wall 14.

In a radial plane E which passes through the carrier ring 22, fitment bodies 30 which are of a shall extent a, as considered in the direction of the axis M of the mixer, project from the inside 11 of the housing, between the two mixing tools 24 which rotate in a propeller-like fashion. In the embodiment shown in FIGS. 1 and 2, the fitment bodies 30 are formed by pin-like portions of a length i which is here somewhat shorter than half the radius q of the peripheral housing portion 12. The angle of attack between the axis Q of the fitment bodies 30 and the corresponding tangent t to the peripheral housing portion 12, as indicated by w in FIG. 2, is there about 90°.

As can be seen in particular from FIG. 1, the two mixing tools 24 are disposed in displaced relationship on the drive shaft 20 and convey the material to be mixed which for reasons of clarity is not shown in the drawing and which is fed to and taken from the mixer 16, which operates in a batch-wise fashion, through closure elements (not shown) in the peripheral housing portion 12 or in the end walls 14, alternately from a mixing space A of the mixer chamber 17 to the other side of the plane E and into a mixing space B. When that happens, the rotary movement (arrow x) of the mixing tools 24 is transmitted to the material being mixed. The outer edges 27 of the mixing tools 24 keep the inside 11 of the housing free from caked-on material in a region which is identified by b in FIG. 1. That freedom from caked-on material is further promoted by the small extent a of the fitment bodies 30, so that the latter represent geometrically small obstacles.

As the material being mixed goes from the one mixing space A or B into the other mixing space B or A respectively, it flows around the fitment bodies 30 which in that situation brake the rotary movement of the material being mixed; strong shearing and frictional forces are produced, which permit intensive and rapid mixing of the components of the mixture.

The mixing characteristics .can be influenced within wide limits by the number, cross-section, length i and angle of attack w of the fitment bodies 30.

The pin-like fitment bodies 30 shown in FIGS. 1, 2 and 6, which are of circular cross-section, have been found to be particularly suitable for example for mixing quartz sand with liquid binding agents. As an example in this respect, fitment bodies 30 of a diameter d of 20 mm and a length i of 100 mm have been found to be highly effective, with a housing radius q of 270 mm.

As shown in FIG. 3, a plurality of mixing tools 24 may be combined in succession in axial relationship with fitment bodies 30 disposed therebetween to provide a continuous-flow mixer $16_a$. The different pitch angle of such mixing tools 24 or mixer blades means that superimposed on the mixing movement is a transportation component from a mixer inlet 32 to a mixed material discharge 34. The individual components of the material to be mixed may also be supplied to the mixer at different locations of the housing 10.

The drawing does not show that, instead of the one blade-like mixing tool 24, a plurality thereof may be arranged in each of the mixing spaces A, B.

The mixing principle discussed hereinbefore in relation to mixers 16, $16_a$ with a horizontal drive shaft 20 also operates in mixers $16_s$ with a perpendicular drive shaft 20 or with an inclined drive shaft. As in such mixer constructions the force of gravity moves the material to be mixed downwardly, it is sufficient in this case, as shown in FIGS. 4 and 5, to provide only one single, upwardly positioned mixing tool 24*a* in a lower mixing space C on a carrier element $22_a$ which here is for example of a bush-like configuration; the return transportation movement of the material being mixed is produced by the force of gravity. An upper mixing space F is disposed above a plane H which here is horizontal and which is defined by the fitment bodies 30 which in this embodiment are made from square steel bar. The upper mixing space F is kept free from caking by a rotating stripper 36; the stripper 36 is of such a configuration that extending from a radial arm 37 on the carrier bush $22_a$ is a vertical portion 38 which stands up in front of end faces 31 of the fitment bodies 30 and which is adjoined above the plane H and after a second radial arm $37_a$ by a second vertical portion $38_a$ which is adjacent the wall. The portion $38_a$ is followed by a crest or top arm 39 which faces towards the axis M of the mixer and which moves with clearance beneath the inside of a housing cover $14_a$.

The vertical portion 38 of the stripper 36, upon movement thereof, entrains mixing material clinging to the end faces 31 of the fitment body 30. In addition the stripper 36 imparts a new radial component of motion to the material being mixed in the upper mixing space F, which is braked in the region between the fitment bodies 30; before the material being mixed can fall back into the lower mixing space C, it is again distributed radially.

Beneath the stripper 36, an additional horizontal rotational profile member 40 projects from the carrier bush $22_a$ adjacent the bottom $14_b$ of the housing; the radial extent n of the profile member 40 approximately corresponds to that of the radial arm 37. The rotational profile member 40 keeps the part of the inside surface of the bottom 14*b* of the housing, which is within the path of movement of the mixing tool edge 29, free from caked-on material.

In FIG. 5, concentric rings 41 connect the fitment bodies 30 to provide a sieve-like flow member above which rotates a part $37_a$, $38_a$ of the stripper 36 while below it rotates the mixing tool $24_a$.

For the purposes of distributing viscous media on the surface of granular substances, the mixer configuration indicated at $16_v$ shown in FIG. 6 has proved particularly successful, in which, in addition to the above-described ccmponents, a roller 42 is also mounted on a radial support arm 43 on the carrier bush $22_a$. The axis K of the roller 42 defines an angle $w_1$ with the axis M of the mixer and the conical peripheral surface 44 of the roller 42 defines with the peripheral housing portion 12 a smaller acute angle $w_2$.

Below the support arm 43 a skirt or apron 45 hangs down towards the bottom $14_b$ of the busing, as a means for entraining the material being mixed.

Upon rotary movement of the mixing rotor assembly 50 comprising the carrier bush $22_a$, the mixing tool $24_a$, the support arm 43 and the roller 42, the latter performs an additional rotary movement of its own, due to the frictional forces acting thereon. That improves the distribution of viscous media on the surface of granular substances. The illustrated angles $w_1$, $w_2$ force the material being mixed to be subjected to an additional three-dimensional turning-over effect.

FIG. 6 only indicates raised portions 46 and recess means 48 in the peripheral surface 44 of the roller 42; retention means of that kind considerably increase the squeezing and shearing forces which act on the material to be mixed.

An upper end face 52 of the roller 42 is to be disposed at a small spacing h relative to the fitment bodies 30; the rotary movement of the mixing rotor assembly 50, in combination with the superimposed rotary movement of the roller 42 about its own axis, cause material clinging to the end face 52 to be removed therefrom.

In the embodiments indicated at $16_s$ and $16_v$ in FIGS. 4 to 6, it is possible to envisage a plurality of planes involving the same structural configuration being arranged in a row vertically one behind the other, as in FIG. 3 in a horizontal direction; a plurality of mixing tools $24_a$ and strippers 36 and mixing rotor assemblies 50 respectively may also be provided at each of those planes, on the drive shaft 20.

The drawing does not show that the housing or the container 10 may also be of a non-cylindrical configuration.

I claim:

1. An apparatus for mixing foundry mould substances, in particular sand and a binding agent, comprising:

a container having two mixing spaces and a drive shaft extending therethrough;

at least two mixing tools projecting substantially radially from said drive shaft and being rotatable with said drive shaft;

said mixing tool having a free end with a substantially planer first edge;

spaced apart fitment bodies of small lateral extent projecting from a wall of the container;

said fitment bodies lying in a first plane which divides said container into said two mixing spaces, said first plane being substantially parallel to a second plane containing said first edge;

said mixing tools conveying said substances being mixed from a first one of said mixing spaces to a second one of said mixing spaces while said substances are being mixed;

said fitment bodies producing strong shearing and frictional forces which cause rapid and intensive mixing of said substances while keeping the wall of the container free from caked-on deposit and brake rotary movement of the substances being mixed; and the fitment bodies being provided between said at least two mixing tools which project in adjacent relationship from the drive shaft and each of which rotates in one of said mixing spaces.

2. An apparatus according to claim 1, wherein the mixing tools are attached to the drive shaft through a carrier ring and the first plane passes through said carrier ring.

3. An apparatus according to claim 1, wherein each said fitment body has a blade-like shape.

4. An apparatus according to claim 3, wherein each said fitment body has a length no greater than half of a radius of the container.

5. An apparatus according to claim 1, wherein each said fitment body has an axis inclined at an angle relative to a tangent to the container wall.

6. An apparatus according to claim 1, wherein said at least two mixing tools project in displaced relationship from a common carrier ring on the drive shaft, and the plane defined by the fitment bodies extends therebetween.

7. An apparatus according to claim 6 wherein a plurality of carrier rings are provided on the drive shaft and at least two mixing tools are mounted on each carrier ring.

8. An apparatus according to claim 1, wherein said two-mixing spaces are disposed in a side-by-side relationship and are separated by a vertical plane.

9. An apparatus according to claim 1, wherein the mixing tool has a surface which is curved in a shape of a ploughshare, and an edge of said surface being adjacent to an inside wall of the container.

10. An apparatus according to claim 9, wherein the surface of the mixing tool is of a part-annular configuration and is connected by means of a racial arm to a carrier ring mounted to the drive shaft.

11. An apparatus according to claim 9, wherein the surface of the mixing tool is of a part-annular configuration and is connected by means of a racial arm to a carrier bush mounted to the drive shaft.

12. An apparatus according to claim 1, wherein the free end of the mixing tool rotates adjacent to an end plate of the container.

13. An apparatus according to claim 1, wherein each said fitment body comprises a pin of small cross-section.

the fitment bodies being provided between said at least two mixing tools which project in adjacent relationship from the drive shaft and each of which rotates in one of said mixing spaces.

* * * * *

UNITED STATES PATENT AND TRADEMARK OFFICE

CERTIFICATE OF CORRECTION

PATENT NO. : 5,393,138

DATED : FEBRUARY 28, 1995

INVENTOR(S) : BERND FEDERHEN

It is certified that error appears in the above-identified patent and that said Letters Patent is hereby corrected as shown below:

IN COLUMN 6, CLAIM 1, LINE 58, DELETE "PLANER" AND INSERT --PLANAR-- IN ITS PLACE.

IN COLUMN 8, CLAIM 10, LINE 14, DELETE "RACIAL" AND INSERT --RADIAL-- IN ITS PLACE.

IN COLUMN 8, CLAIM 11, LINE 18, DELETE "RACIAL" AND INSERT --RADIAL-- IN ITS PLACE.

IN COLUMN 8, CLAIM 13, DELETE LINES 25, 26, 27 AND 28 IN THEIR ENTIRETY.

Signed and Sealed this

Twenty-seventh Day of June, 1995

Bruce Lehman

*Attest:*

BRUCE LEHMAN

*Attesting Officer*

*Commissioner of Patents and Trademarks*